US005192150A

United States Patent [19]

Rüggeberg

[11] Patent Number: 5,192,150

[45] Date of Patent: Mar. 9, 1993

[54] COMPUTER KEYBOARD TEMPLATE SELECTOR

[76] Inventor: Karl A. Rüggeberg, 129 Lancer Rd., Riverside, Conn. 06878

[21] Appl. No.: 757,223

[22] Filed: Sep. 10, 1991

[51] Int. Cl.[5] ..... B41J 5/00

[52] U.S. Cl. ..... 400/477; 364/708

[58] Field of Search ..... 400/472, 477, 479; 341/23; 235/145 R, 146; 364/708, 709.1; 40/388-391

[56] References Cited

U.S. PATENT DOCUMENTS

| | | | |
|---|---|---|---|
| 3,560,964 | 2/1971 | Bedell et al. | 341/23 |
| 3,835,560 | 9/1974 | Mori | 40/389 |
| 3,987,565 | 10/1976 | Mori | 40/389 |
| 4,279,021 | 7/1981 | See et al. | 364/709.1 |
| 4,381,500 | 4/1983 | Urata et al. | 341/23 |
| 4,680,455 | 7/1987 | Kuo | 235/146 |
| 4,935,888 | 6/1990 | Heston et al. | 364/708 |

*Primary Examiner*—Edgar S. Burr
*Assistant Examiner*—Ren Yan
*Attorney, Agent, or Firm*—Kane, Dalsimer, Sullivan, Kurucz, Levy, Eisele and Richard

[57] ABSTRACT

The computer keyboard template selector is an apparatus which attaches to a computer keyboard to hold a plurality of computer keyboard templates. The apparatus includes a body and a lid, wherein the lid is urged upwardly to an open position by a wrap spring and held in a closed position by a detent structure. Several rotatable separator sheets with staggered laterally extending tabs are enclosed in the apparatus. Each separator sheet holds a computer keyboard template. The staggered laterally extending tabs form an inverted stair structure so that a lifting device can be positioned under a laterally extending tab so as to lift a number of separator sheets when the detent structure is released and the lid is opened thereby exposing a selected computer keyboard template.

12 Claims, 3 Drawing Sheets

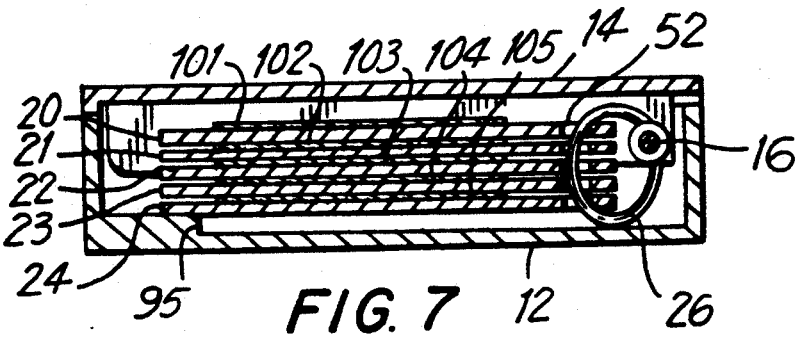
FIG. 7
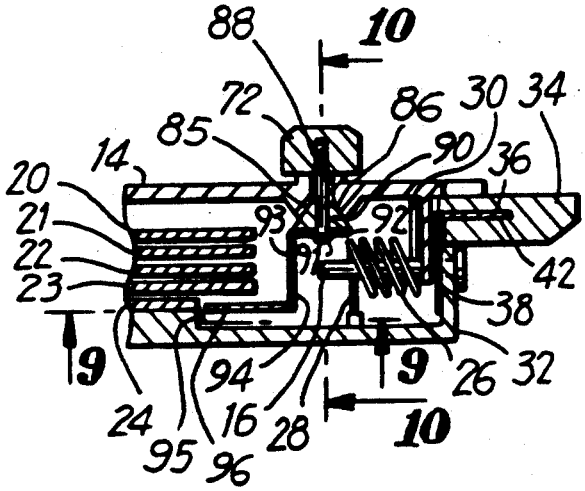
FIG. 8
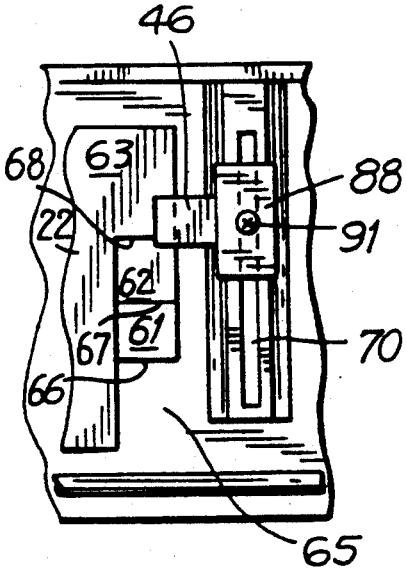
FIG. 9
FIG. 10
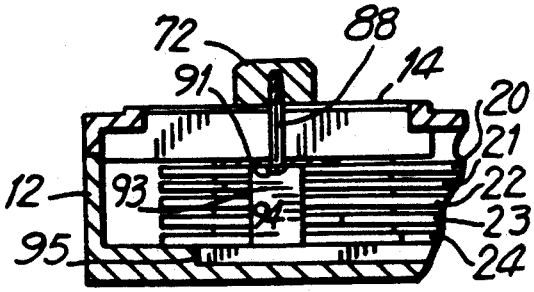

COMPUTER KEYBOARD TEMPLATE SELECTOR

BACKGROUND OF THE INVENTION

1. Field of the Invention

This invention pertains to a device for holding multiple computer keyboard templates and/or reference guides in a secure and organized configuration on a computer keyboard, allowing for the rapid selection of a desired computer keyboard template and/or reference guide for the application program chosen by the user.

2. Description of the Prior Art

In the prior art, it is well-known that different programs for the personal computer assign different and unique functions to the function keys (typically known as F1 through F12 keys, or even F1 through F15 keys on some computers). Moreover, each function key is typically assigned four possible different functions, these functions being chosen by depressing a function key either alone or in combination with one of three other keys (e.g., the "shift" key, the "alt" key, or the "control" key). In order to indicate these possible choices to the user, computer programs are typically provided with a template or reference guide to be positioned above or around the row of function keys on a standard computer keyboard.

However, particularly with use of "Windows"®, even the novice personal computer user can easily use several computer programs—word processing, spreadsheets, data base, drafting, utility, hard disk management, communications, games, etc.—each with its own particular use of the function keys and each requiring its own template or reference guide (hereinafter the term "template" shall include similar reference guides). Switching between these programs is readily performed by typing the appropriate instructions into the keyboard or by means of a pointing device such as a mouse. However, to the user's dismay, he or she may find that the desired function key template or reference guide is not easily located when needed. Therefore, the user has to stop working to locate the template among other loose templates and place the template on the keyboard, making sure to align the template properly.

OBJECTS AND SUMMARY OF THE INVENTION

It is therefore an object of this invention to allow the personal computer user to keep the user's computer keyboard templates organized and easily accessible.

It is therefore a further object of this invention to allow the personal computer user to keep the user's computer keyboard templates rapidly accessible in a aligned condition.

It is therefore a final object of this invention to allow the personal computer user to select and arrange the computer keyboard templates particular to the user's chosen programs in a manner defined by the user.

These and other objects are attained by providing a computer keyboard template selector which includes several separator sheets engaging a hinge means along the upper longitudinal edge of a body which is placed upwardly adjacent to the function keys of a computer keyboard. Each separator sheet provides a surface onto which computer keyboard templates for different computer programs may be placed. The body includes a spring-loaded lid which is commonly hinged with the separator sheets. The lid further includes detent means to keep the lid in a closed position during non-use.

The separator sheets include staggered tabs on a lateral end thereof thereby forming an inverted stair structure. The tabs of the separator sheet forming the inverted stair structure are selectively engaged by an L-shaped tab which slides within a slot o the lid of the body. The user selectively positions the L-shaped tab so as to engage and lift all separator sheets above a selected separator sheet thereby exposing the computer keyboard template attached to the selected separator sheet.

BRIEF DESCRIPTION OF THE DRAWINGS

Further objects and advantages of the invention will become apparent from the following description and claims, and from the accompanying drawings, wherein:

FIG. 7 is a cross-sectional view along plane 7—7 of FIG. 5.

FIG. 8 is a cross-sectional view along plane 8—8 of FIG. 4.

FIG. 9 is a cross-sectional view along plane 9-9 of FIG. 8.

FIG. 10 is a cross-sectional view along plan 10—10 of FIG. 8.

DETAILED DESCRIPTION OF THE PREFERRED EMBODIMENT

Figure 1:
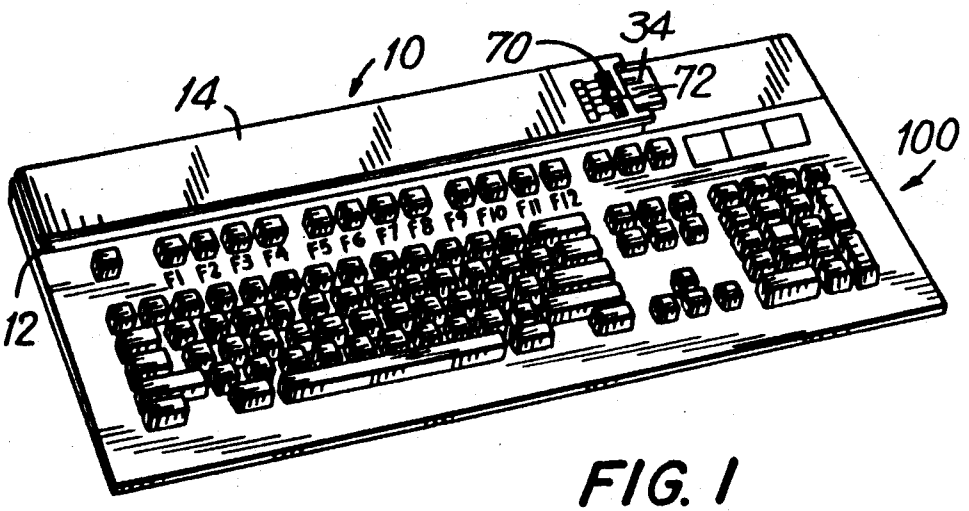
FIG. 1 is a perspective view of a typical computer keyboard with the computer keyboard template selector attached thereto.
Figure 3:
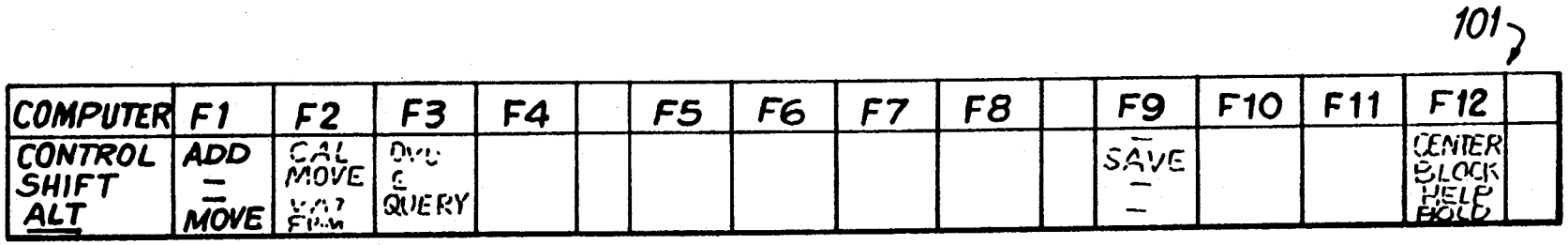
FIG. 3 is a front plan view of a representative computer keyboard template.

Referring now to the drawings in detail wherein like numerals represent like elements throughout the several views, one may see that FIG. 1 is a perspective view of the computer keyboard template selector 10 secured to a computer keyboard 100 upwardly adjacent to the function keys F1–F12. As shown in FIG. 3, a computer keyboard template 101 typically lists the functions available by the depression of the function key alone or in combination with other keys (typically the "shift", "alt" or "control" keys) and is proportioned to align with the respective function keys so that the user can rapidly determine the desired keystroke sequence. Those skilled in the art will realize that the computer keyboard template selector 10 is adaptable to other numbers and/or locations of function keys. Similarly, those skilled in the art will recognize additional possible features such as a miniature calculator (not shown) attached to the computer keyboard template selector 10.

Figure 2:
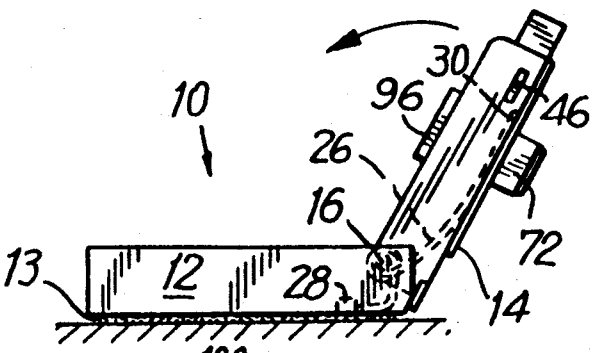
FIG. 2 is a side plan view, partly in cross section, of the computer keyboard template selector.

As shown in FIG. 2, the computer keyboard template selector 10 includes a base 12 and a lid 14. Base 12 is engaged to the computer keyboard 100 by an adhesive layer 13 or a suitable substitute. Additionally, base 12 may be provided or engaged as an integral part of computer keyboard 100. Lid 14 is hingedly secured to base 12 by means of a rod 16 inwardly adjacent to the upper longitudinal edge 18 of selector 10 (also see FIG. 6). Rod 16 serves as a hinge between the base 12 and the lid 14. Moreover, as shown on FIGS. 6 and 7, rod 16 further serves as an axis of rotation or hinge for separator sheets 20–24.

Figure 4:
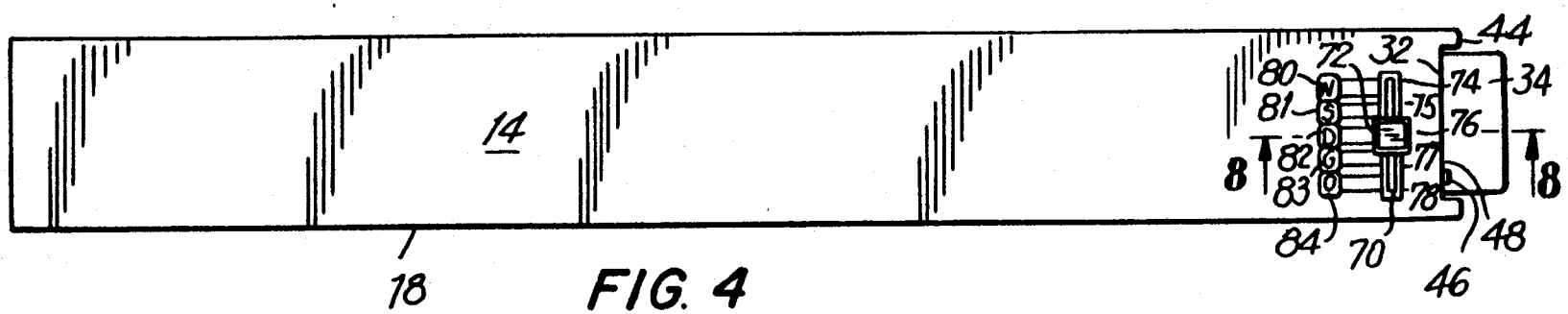
FIG. 4 is a top plan view of the closed computer keyboard template selector.
Figure 5:
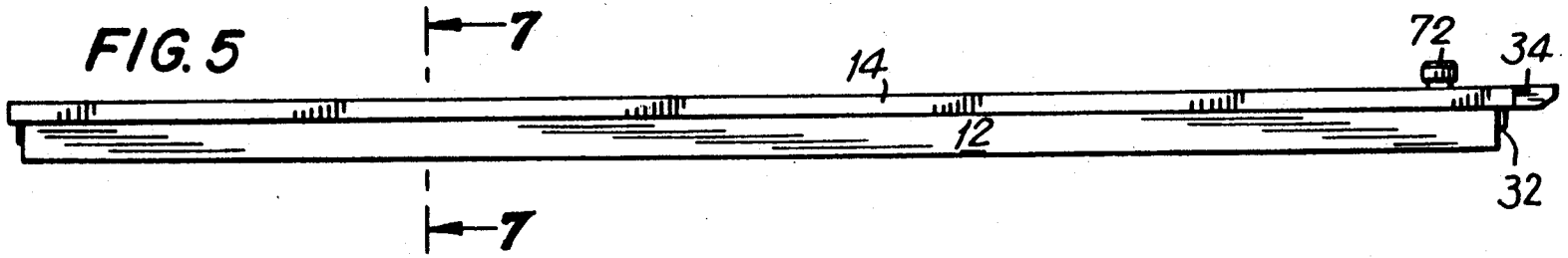
FIG. 5 is a front plan view of the closed computer keyboard template selector.
Figure 6:
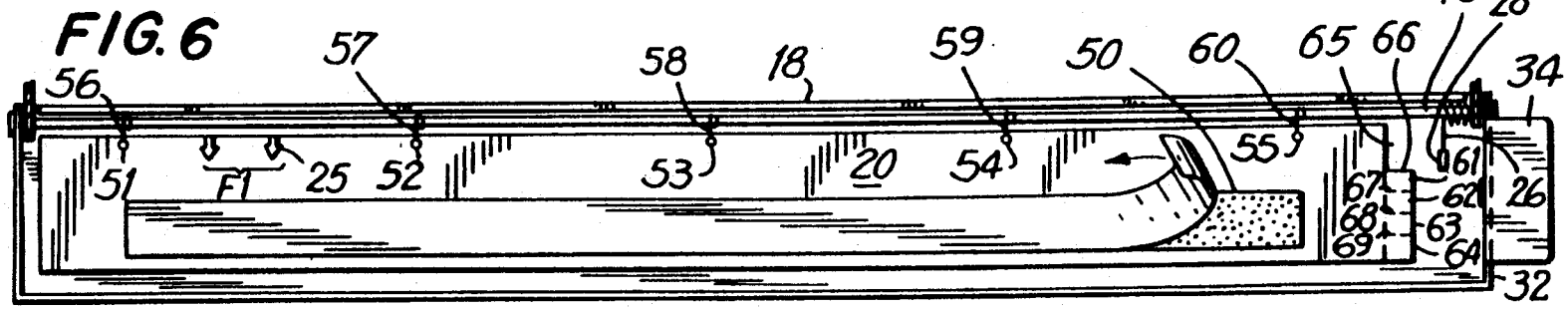
FIG. 6 is a top plan view, partly in cross-section, of the base of the computer keyboard template selector.

As shown in FIGS. 2, 6 and 8, wrap spring 26 includes a first end 28 fixed in base 12, wraps around rod 16 and includes a second end 30 which upwardly urges lid 14. As shown in FIGS. 4, 5, 6 and 8, the right lateral side 32 of base 12 includes a release tab 34 which is resiliently engaged thereto by metal tab 36 which includes a vertical portion 38 secured to right lateral side 32 of base 12 and a horizontal portion 42 embedded within release tab 34. Further, as shown in FIG. 4, the right lateral side 44 of lid 14 includes a detent protrusion 46 which, when lid 14 is closed, extends into detent slot 48 of side release tab 34. Release tab 34, in its natural upward position, engages detent protrusion 46 into detent slot 48 thereby serving as a detent means to hold lid 14 in a closed position over base 12. The user may depress release tab 34 to withdraw detent slot 48 from detent protrusion 46 so that wrap spring 26 will force lid 14 to an open position.

As shown in FIG. 6, computer keyboard template selector 10 includes separator sheets 20–24. Each separator sheet 20–24 includes an adhesive strip 50 for adhering to computer keyboard templates 101–105 (such as shown in FIG. 6). Further, each separator sheet 20–24 includes apertures 51–55 through which wires 56–60 pass and engage rod 16 so as to provide an axis for rotation for separator sheets 20–24 (as shown in FIG. 7). Additionally, separator sheets 20–24 may include arrows 25 to serve as an alignment means both in the positioning of base 12 onto keyboard 100 and the placement of computer keyboard templates 101–105 onto separator sheets 20–24.

As shown on the far right hand side of separator sheet 20–24 on FIG. 6, tabs 61–64 laterally protrude from sheets 20–23 (with no tab on sheet 24), respectively, so as to form an inverted stair structure. The top separator sheet 20 has the widest tab 61 as defined by edge 66 and forming notch 65. The next to the top separator sheet 21 has the next widest tab 62 as defined by edge 67. The third to the top separator sheet 22 has the third widest tab 63 as defined by edge 68. The next to the bottom separator sheet 23 has the narrowest tab 64 as defined by edge 69. The bottom separator sheet 24 has no tab.

As shown on FIG. 4, lid 14 includes a slot 70 through which a selector button 72 slides between five positions 74–78. Ideally, positions 74–78 include a detent means to assure that a chosen position 74–78 is firmly engaged. Positions 74–78 include respective detachable labels 80–84 representative of respective computer keyboard templates 101–105 secured to respective separator sheets 20–24. In FIG. 4, labels 80–84 include the five letters W, S, D, G, and O which could stand for "Word-Processing", "Spreadsheet", "Data Base", "Graphics" (or "Games"), and "Other", respectively.

As shown in FIG. 8, slot 70 includes inverted V-shaped walls 85, 86 on the interior of lid 14. Selector button 72 is fixed to a calibrating screw 88 which extends through slot 70 and engages a wedge structure 90 against walls 85, 86. Additionally, the head 91 of calibrating screw 88 engages an upper horizontal portion 92 of a lifting tab 93. A vertical portion 94 of lifting tab 93 extends down to the top of a ridge 95 upon which the separator sheets 20–24 rest. A lower horizontal portion 96 extends from vertical portion 94 under the separator sheets 20–24 adjacent to ridge 95.

By moving the selector button 72 to a desired position, lower horizontal portion 96 of lifting tab 93 is positioned directly under one of tabs 61–64 or notch 65 of separator sheets 20–23 as shown in FIG. 9. The lowermost separator sheet 24 is preferably never engaged by lower horizontal portion 96 of lifting tab 93. Furthermore, when selector button 72 is in its uppermost position 74 (position W as shown in FIG. 4), lower horizontal portion 96 of lifting tab 93 is positioned under notch 65 clear of tabs 61–64. When the release tab 34 is subsequently depressed, detent slot 48 is pulled away from detent protrusion 46 and wrap spring 26 urges lid 14 to an open position.

As lid 14 is urged to an open position, lower horizontal portion 96 of lifting tab 93 is urged upwardly to lift a number of separator sheets (20–23, with sheet 24 remaining stationary) dependent upon the position of selector button 72 as follows:

1. When selector button 72 is in position 74 (labelled "W" in FIG. 4) prior to the opening of lid 14, lower horizontal portion 96 of lifting tab 93 is positioned under notch 65 so that when lid 14 opens, no separator sheets are raised and the computer keyboard template 101 on separator sheet 20 is exposed.

2. When selector button 72 is in position 75 (labelled "S" in FIG. 4) prior to the opening of lid 14, lower horizontal portion 96 of lifting tab 93 is positioned under tab 61 adjacent to edge 66 so that when lid 14 opens, separator sheet 20 is raised and the computer keyboard template 102 on separator sheet 21 is exposed.

3. When selector button 72 is in position 76 (labelled "D" in FIG. 4) prior to the opening of lid 14, lower horizontal portion 96 of lifting tab 9 is positioned under tab 62 adjacent to edge 67 so that when lid 14 opens, separator sheets 20, 21 are raised and the computer keyboard template 103 on separator sheet 22 is exposed.

4. When selector button 72 is in position 77 (labelled "G" in FIG. 4) prior to the opening of lid 14, lower horizontal portion 96 of lifting tab 93 is positioned under tab 63 adjacent to edge 68 so that when lid 14 opens, separator sheets 20, 21, 22 are raised and the computer keyboard template 104 on separator sheet 23 is exposed.

5. When selector button 72 is in position 78 (labelled "O" in FIG. 4) prior to the opening of lid 14, lower horizontal portion 96 of lifting tab 93 is positioned under tab 64 adjacent to edge 69 so that when lid 14 opens, separator sheets 20, 21, 22, 23 are raised and the computer keyboard template 105 on separator sheet 24 is exposed.

To use computer keyboard template selector 10, the user initially fastens the base 12 of the selector 10 to the computer keyboard 100 by adhesive layer 13 using arrow 25 to position the base 12 with respect to the function keys of computer keyboard 100. The user then aligns (again using arrow 25 to align the template portion corresponding to the F1 function key) and fastens computer keyboard templates 101–105 to separator sheets 20–24 using adhesive strips 50. The user then places the appropriate labels 80–84 in positions 74–78 to indicate the nature of the computer keyboard templates 101–105 on the respective separator sheets 20–24.

When the user subsequently desires to view a chosen computer keyboard template 101–105 while using the computer keyboard 100, the user positions selector button 72 to the appropriate position 74–78 while the lid 14 is closed. The user then depresses release tab 34 to expose the chosen computer keyboard template 101–105 as described herein.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An apparatus for selecting and displaying a computer keyboard template from among a plurality of computer keyboard templates, the apparatus comprising:

a base including means for attaching said base to a computer keyboard;

a lid including hinge means attached to said base;

a plurality of separator sheets rotatably engaging said base, each of said separator sheets providing a surface including an adhesive strip for engaging a computer keyboard template, at least one of said separator sheets further including a laterally extending tab;

wherein each of said laterally extending tabs are wider than any lower adjacent laterally extending tab thereby forming an inverted stair structure;

selecting means which is movable to a plurality of positions, each of said plurality of positions corresponding to one of said separator sheets;

said selecting means moving a lifting means which selectably engages said laterally extending tabs whereby when said lid is subsequently opened, a selected laterally extending tab, a selected separator sheet corresponding thereto, and all separator sheets above said selected separator sheet are lifted to expose a separator sheet below said selected separator sheet; and a label adjacent to each of said plurality of positions corresponding to a computer template exposed by said lifting means when said selecting means is placed in a respective position chosen from said plurality of positions.

2. The apparatus of claim 1 further including spring means for urging said lid to an open position with respect to said base.

3. The apparatus of claim 2 wherein said detent means includes;

a release tab means on said body, wherein said release tab means further includes a detent slot; and a protrusion on said lid whereby said lid is held in a closed position when said protrusion is engaged in said detent slot and whereby said lid is released by urging said release tab means.

4. The apparatus of claim 2 further including detent means for releasable securing said lid to said base in a closed position.

5. The apparatus of claim 4 wherein said lifting means includes a slot in said lid and a lifting tab, with a selector means extending through said slot and engaging said lifting tab, wherein said lifting tab includes a vertical portion extending downwardly from said selector means, said vertical portion engaging a horizontal portion which selectively engages said laterally extending tabs.

6. The apparatus of claim 5 wherein said base includes a ridge, and a bottommost selector sheet rests upon a top of said ridge and said horizontal portion is below said top of said ridge.

7. The apparatus of claim 6 wherein said selector means includes a selector button, and said slot includes selected positions corresponding to where said selector button is placed to position said horizontal portion to respective laterally extending tabs.

8. The apparatus of claim 7 wherein said hinge means comprises a bar inwardly adjacent of an upward longitudinal edge of said body, and wherein said separator sheets are rotatably engaged to said bar.

9. The apparatus of claim 8 wherein said separator sheets include apertures through which wire is passed to rotatably engage said separator sheets to said bar.

10. The apparatus of claim 8 wherein said separator sheets further include means for aligning the apparatus with a computer keyboard and the apparatus with the computer keyboard templates.

11. The apparatus of claim 8 wherein an interior portion of said slot includes an upwardly extending V-shaped cross section, said selector means includes an upwardly extending wedge-shaped cross section and wherein said wedge-shaped cross section engages said V-shaped cross section.

12. The apparatus of claim 11 further including a calibration screw engaging said upwardly extending wedge-shaped cross section to said selector button.

* * * * *